US006409552B2

(12) United States Patent
Matsumoto

(10) Patent No.: US 6,409,552 B2
(45) Date of Patent: Jun. 25, 2002

(54) CONNECTOR

(75) Inventor: Koichi Matsumoto, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/845,314

(22) Filed: May 1, 2001

(30) Foreign Application Priority Data

Jun. 2, 2000 (JP) ..... 2000-165603

(51) Int. Cl.[7] ..... H01R 13/436
(52) U.S. Cl. ..... 439/752; 439/271
(58) Field of Search ..... 439/752, 595, 439/271–273

(56) References Cited

U.S. PATENT DOCUMENTS 5,593,326 A * 1/1997 Listing ..... 439/752
5,692,929 A 12/1997 Hoffmann ..... 439/752
6,089,927 A * 7/2000 Seko et al. ..... 439/752
6,264,497 B1 * 7/2001 Murakami et al. ..... 439/752

* cited by examiner

*Primary Examiner*—Gary F. Paumen
(74) *Attorney, Agent, or Firm*—Banner & Witcoff, Ltd.

(57) ABSTRACT

A female housing 20 is provided with a terminal housing member 21, which houses a female terminal fitting 24, and a female hood 22 that surrounds the terminal housing member 21. Inserting areas S are formed between the terminal housing member 21 and the female hood 22, a male hood 11 of a male housing 10 being inserted into these inserting areas S. A retainer attachment hole 25 is formed in the terminal housing member 21. A retainer 30 is attached within this retainer attachment hole 25, which retains the female terminal fitting 24. A retainer through hole 27, which passes through to the retainer attachment hole 25, is formed in the female hood 22. A guiding face 33 is formed on a face of the retainer 30 that faces towards the-male housing 10. When the retainer 30 is in a temporary retaining position, this guiding face 33 is located in the vicinity of the inserting area S. When the two housings 10 and 20 are fitted together, an anterior edge of the male hood 11 makes sliding contact with the guiding face 33, thereby pushing the retainer 30 from the temporary retaining position to a main retaining position whereby the retainer 30 retains the female terminal fitting 24.

14 Claims, 2 Drawing Sheets

CONNECTOR

CONNECTOR

TECHNICAL FIELD

The present invention relates to an electrical connector.

BACKGROUND TO THE INVENTION

One example of a waterproof electrical connector is described in U.S. Pat. No. 5692929. In this waterproof connector, a male hood of a male housing is capable of fitting into the space between a terminal housing member of a female housing and a female hood that surrounds-this terminal housing member. A sealing ring-fitted to an outer circumference face of the terminal housing member fits tightly with the male hood, thereby waterproofing the connector.

This example discusses a means for doubly retaining terminal fittings housed within the terminal housing member of the female housing. In order to obtain a strong retaining force, these terminal fittings are retained directly by a side retainer inserted from one side. A retainer through hole, for allowing the side retainer to be attached, opens into a side face of the female hood. The retainer is pushed through this retainer through hole until it reaches a correct position for retaining the terminal fittings.

Conventionally, the size of this retainer through hole is the minimum required to allow the retainer to pass therethrough. Consequently, it is difficult to push the retainer, and it may even become stuck part-way through the pushing operation. The present invention has taken the above problem into consideration, and aims to present a connector wherein the retainer is simply and reliably pushed to the correct position.

U.S. Pat. No. 5,692,929 discloses a retainer which is inserted from fitting side of the connector, and is movable from side to side via a through hole in the side of the connector housing. Such a retainer is large, and requires a corresponding large connector housing.

SUMMARY OF THE INVENTION

According to the invention there is provided a connector comprising first and second housings mutually engageable in an attachment direction, said first housing having a tubular terminal housing member adapted to house a terminal fitting, and a hood surrounding said terminal housing member to define a continuous channel open in the attachment direction, and said second housing being insertable into said channelon engagement of said first and second housings, wherein said first housing defines a retainer insertion hole extending substantially at right angles to said attachment direction from the exterior of said first housing via said channel into said tubular housing member, and adapted to receive a retainer, the retainer being insertable through said retainer insertion hole from a waiting position to a final position in which the retainer protrudes into said tubular housing member to retain a terminal fitting against removal, characterised in that one of said retainer and second housing is provided with an inclined face for contact with the other of said retainer and second housing whereby insertion of said second housing into said channel moves said retainer from the waiting position to the final position.

Such an arrangement ensures that the retainer is automatically inserted to the final position as the housings are engaged, and providing that the terminal fitting is fully inserted.

Preferably the outer side of the retainer is flush with the mouth of the retainer through-hole in the waiting position-this avoids transit damage. In this case the inclined face is preferably located on the retainer and in the channel for engagement by the second housing. This arrangement has the advantage that friction between the retainer and the housing is reduced by virtue of the inclined face on the retainer.

BRIEF DESCRIPTION OF DRAWINGS

Other features of the invention will be apparent from the following description of a preferred embodiment shown by way of example only in the accompanying drawings, in which.

DESCRIPTION OF PREFERRED EMBODIMENT

Figure 3:
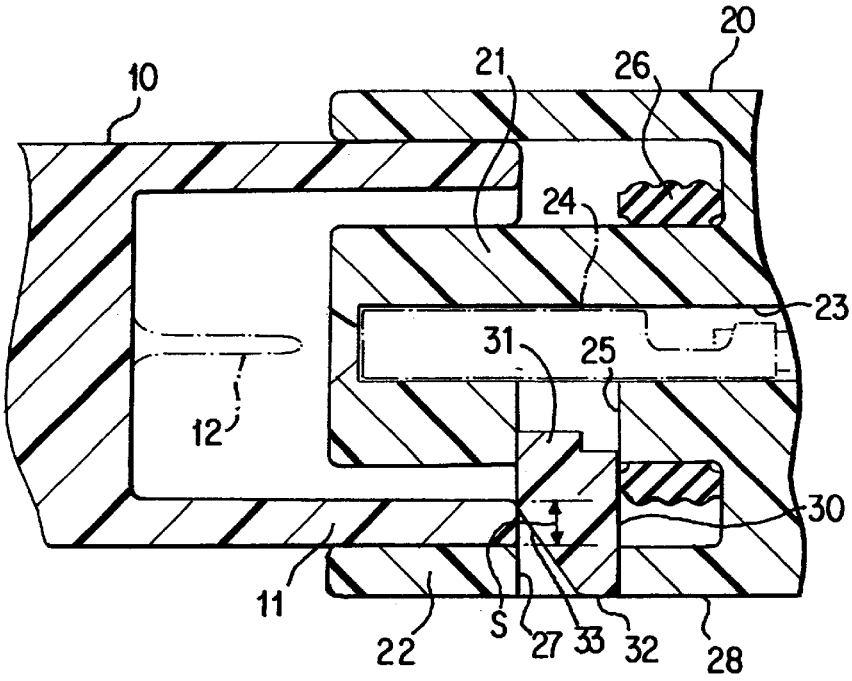
FIG. 3 is a side cross-sectional view showing two housings being fitted together.
Figure 4:
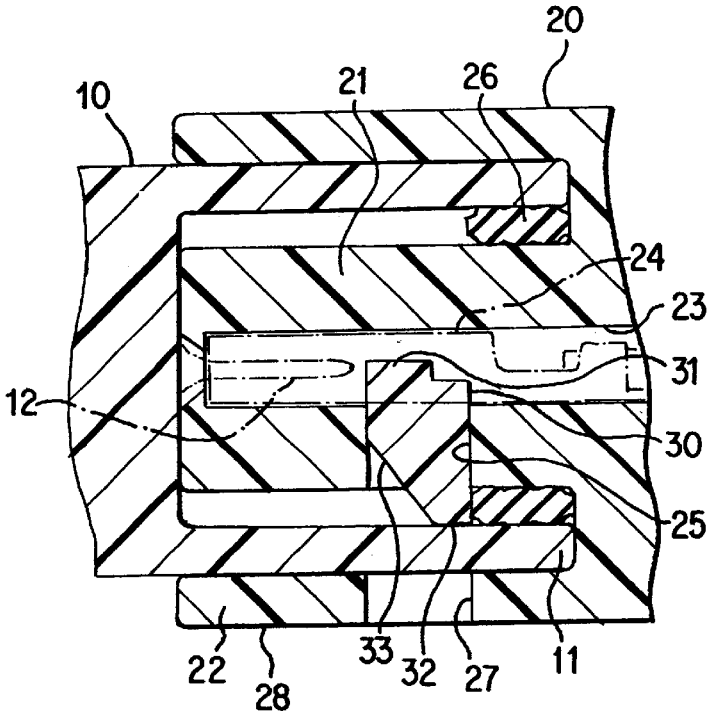
FIG. 4 is a side cross-sectional view showing the two housings in a correctly fitted state.

An embodiment of the present invention is described below with the aid of FIGS. 1 to 4. As shown in FIG. 4, a connector of the present embodiment has a male connector housing 10 and a female connector housing 20 capable of fitting together, and a waterproofing sealing ring 26 attached to the female housing 20. Fitting face sides of the two housings 10 and 20 will hereafter be considered as the anterior sides.

A cylindrical hood 11 protrudes towards the anterior from the male housing 10. A male terminal fitting 12 protrudes within this hood 11 from a wall face thereof. The female housing 20 has a terminal housing member 21 for housing a female terminal fitting 24, and a female hood 22 that surrounds this terminal housing member 21. The hood 11 of the male housing 10 can be inserted into a space between the terminal housing member 21 and the female hood 22. An area marked by the letter S in FIG. 1 (that is, an area extending from inner faces of the female hood 22 to inner sides of the male hood 11, corresponding to the thickness of the male hood 11) is an inserting area S allowing the insertion of the male housing 10.

A cavity 23 extends within the terminal housing member 21 in the fitting direction of the two housings 10 and 20. A female terminal fitting 24 can be inserted into this cavity 23 from the posterior. A retainer attachment hole 25 is formed at an approximately central portion of the terminal housing member 21, a retainer 30 being attached therein from below (from a side face), relative to FIG. 1. The retainer attachment hole 25 extends in a direction which is at a right angle to the axial direction of the female terminal fitting 24 inserted into the cavity 23, and opens into an inner side face of the cavity 23. The sealing ring 26 is attached to outer circumference faces of the terminal housing member 21 at locations immediately to the posterior of the retainer attachment hole 25. A wall that joins the terminal housing member 21 and the female hood 22 is located immediately to the posterior of the sealing ring 26. A retainer through hole 27 passes through the lower portion (relative to FIG. 1) of the female hood 22, this joining the retainer attachment hole 25 of the terminal housing member 21. The retainer 30 that is attached to the terminal housing member 21 can be passed through this retainer through hole 27. An opening area of the retainer through hole 27 is the minimum required to allow the retainer 30 to pass therethrough. Furthermore, the female terminal fitting 24 is provided with a lance (not shown) that causes it to engage with an inner face of the cavity 23.

Figure 1:
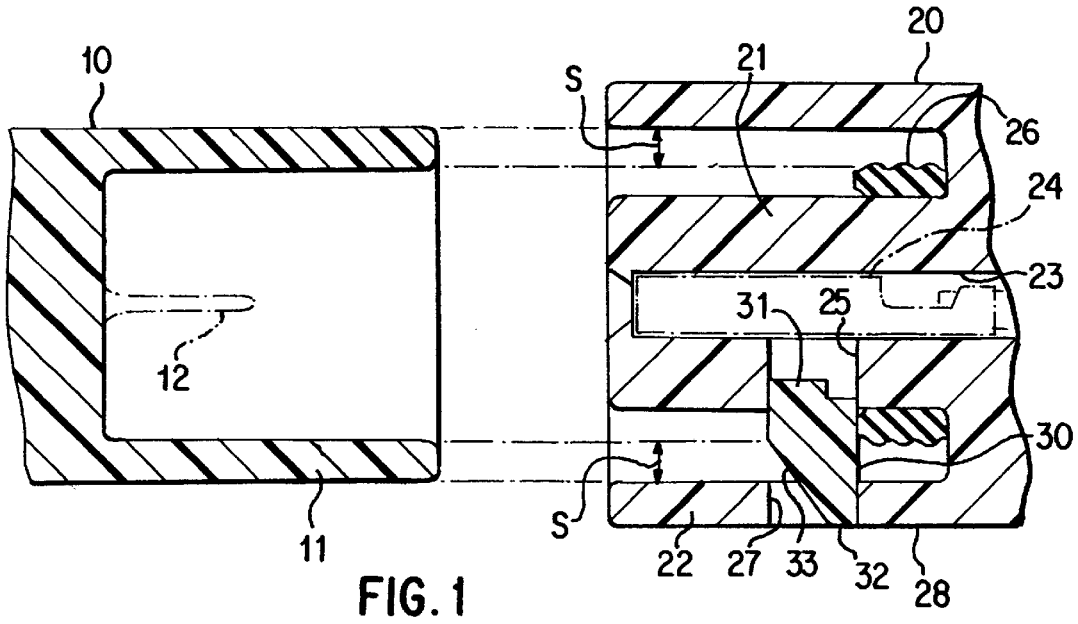
FIG. 1 is a disassembled side cross-sectional view showing a connector of an embodiment of the present invention.
Figure 2:
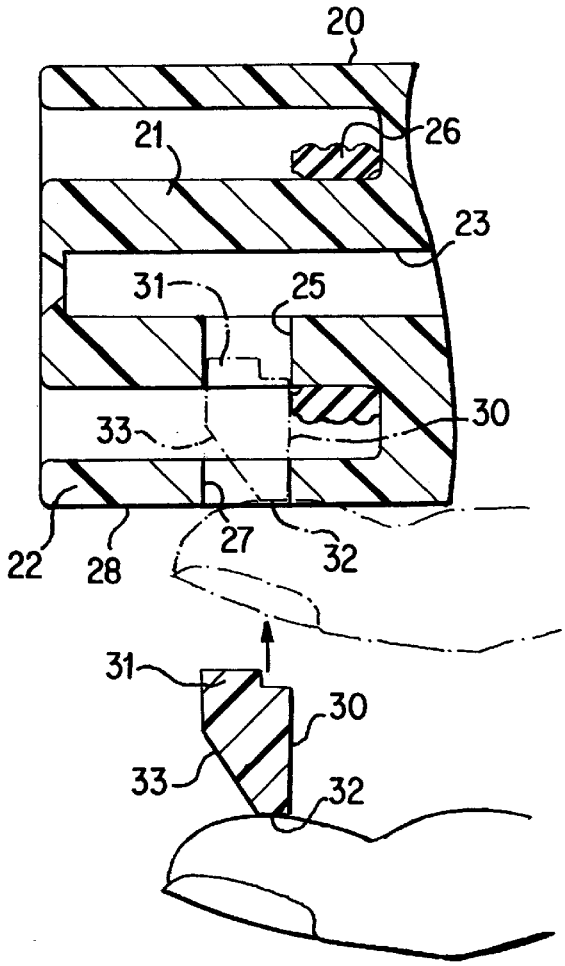
FIG. 2 is a side cross-sectional view showing a female housing and a retainer.

As shown. in FIG. 2, the retainer 30 is passed through the retainer through hole 27 at the bottom (from one side) of the female hood 22. An inner side of the retainer 30 can be inserted within the retainer attachment hole 25 of the terminal housing member 21. An engaging member 31 is formed on an upper side, relative to FIG. 2, of the retainer 30 (this upper side being an innermost edge, relative to the attachment direction, of the retainer 30). The engaging member 31 is capable of engaging with the female terminal fitting 24. The retainer 30 can be moved between a temporary retaining position, whereby the engaging member 31 is outside the cavity 23, this allowing the female terminal fitting 24 to be inserted into the cavity 23 (see FIG. 1), and a main retaining position, whereby the engaging member 31 protrudes into the cavity 23 and engages with the female terminal fitting 24 (see FIG. 4). As shown in FIG. 1, when the retainer 30 is located in the temporary retaining position, an outer side face 32 of the retainer 30 is located so as to form an approximately unified face with an outer side face 28 of the female hood 22. When the retainer 30 is located in the main retaining position, the outer side face 32 of the retainer 30 is located so as to be in approximately the same position as an inner edge of the inserting area S. A maintaining means (not shown) is used to maintain the retainer 30 relative to the terminal housing member 21 in either the temporary retaining position or the main retaining position.

As shown in FIG. 1, a guiding face 33 is formed on an edge portion of a side of the retainer 30 that is opposite the engaging member 31 (that is, the guiding face 33 is formed on the outer side relative to the attaching direction of the retainer 30). The guiding face 33 is formed on an anterior face of the retainer 30 (the face opposite the male housing 10) and is inclined towards the anterior. The guiding face 33 adjoins an anterior side face of the retainer 30 that extends along the retainer attachment hole 25, and also adjoins an anterior side (relative to the fitting direction of the two housings 10 and 20) of the outer side face 32 of the retainer 30.

When the retainer 30 is in the temporary retaining position, an inner edge of the guiding face 33 is located so as to be in approximately the same position as the inner edge of the inserting area S. That is, the guiding face 33 is located within the inserting area S before the retainer 30 is moved from the temporary retaining position to the main retaining position. An anterior edge of the male hood 11 that is being inserted into the inserting area S makes sliding contact with the guiding face 33. As shown in FIG. 2, the outer side face 32 of the retainer 30 can be pushed when the retainer 30 is to be attached to the female housing 20.

The present embodiment is configured as described above. Next, the operation thereof will be described. First, the retainer 30 is attached, in the temporary retaining position, to the female housing 20. As shown in FIG. 2, the retainer 30 is inserted into the retainer through hole 27 of the female housing 22, the retainer 30 being pushed until the outer side face 32 thereof reaches a position where it forms an approximately unified face with the outer side face 28 of the female hood 22. In this manner, the retainer 30 is attached to the retainer attachment hole 25 of the terminal housing member 21 and is maintained in the temporary retaining position. This attaching operation of the retainer 30 is easily performed by hand.

Next, the female terminal fitting 24 is inserted from the posterior into the cavity 23. The lance thereof (not shown) engages with the inner face of the cavity 23, thereby retaining the female terminal fitting 24. Then the fitting operation of the two housings 10 and 20 is performed.

The fitting operation of the two housings 10 and 20 is performed by inserting the male hood 11 of the male housing 10 into the inserting spaces S of the female housing 20. Then, as shown in FIG. 3, the anterior edge of the male hood 11 makes contact with the guiding face 33 of the retainer 30, this guiding face 33 being located within the inserting area S. As the fitting operation of the two housings 10 and 20 progresses from this state, the anterior edge of the male hood 11 makes sliding contact with the guiding face, and the retainer 30 is automatically pushed inwards in its direction of attachment.

When the two housings 10 and 20 are fitted to a depth whereby the inner face of the male hood 11 makes contact with the outer side face 32 of the retainer 30, the retainer 30 has been pushed to the main retaining position, the engaging member 31 engaging with the female terminal fitting 24. By this means, the female terminal fitting 24 is in a doubly retained state. As shown in FIG. 4, when the two housings 10 and 20 have been fitted to the correct inserting depth, the sealing ring 26 fits tightly with an inner face of the anterior edge of the male hood 11, thereby waterproofing the two housings 10 and 20.

If the female terminal fitting 24 is partially inserted into the cavity 23 before the two housings 10 and 20 are fitted together, the retainer 30 cannot be pushed to the main retaining position while the fitting operation takes place, and consequently this fitting operation cannot be continued. In that case, the female terminal fitting 24 is pushed to the correct depth, and then the two housings 10 and 20 are fitted together.

In the embodiment described above, the male hood 11 that is inserted into the inserting area S makes sliding contact with the guiding face 33 provided at the anterior face of the retainer 30. Consequently, the fitting operation of the two housings 10 and 20 is used to push the retainer 30 inwards, and the retainer 30 can easily and reliably be pushed into the main retaining position.

When the retainer 30 is attached in the temporary retaining position, whereby the outer side face 32 thereof forms an approximately unified face with the outer side face 28 of the female hood 22, the operation of fitting the two housing 10 and 20 together causes the retainer 30 to be pushed automatically into the main retaining position. This completely eliminates the need to perform any operation on the retainer 30 via the retainer through hole 27, and the attachment operability of the retainer 30 is thereby improved.

Friction between the retainer 30 and the housing 20 is reduced because the inclined face 33 is not in contact with the edge of the through hole 27 of the female hood 22, as illustrated in FIG. 1.

The present invention is not limited to the embodiments described above with the aid of figures. For example, the possibilities described below also lie within the technical range of the present invention. In addition, the present invention may be embodied in various other ways without deviating from the scope thereof.

(1) In the embodiment described above, the guiding face is provided only on the retainer. However, a guiding face, inclined at the same angle as the guiding face of the retainer, may equally well be provided on the anterior edge of the male hood as well.

(2) Furthermore, the guiding face may be provided only on the male housing. In that case, when the retainer is in the temporary retaining position, the outer side face of the retainer may be located within the inserting area.

(3) In the embodiment described above, the outer side face of the retainer and the outer side face of the female hood form an approximately unified face when the retainer is in the temporary retaining position. However, this need not be the case. For example, the retainer may equally well be in a temporary retaining position whereby it protrudes from the female hood.

What is claimed is:

1. A connector comprising first and second housings mutually engageable in an attachment direction, said first housing having a tubular terminal housing member adapted to house a terminal fitting, and a hood surrounding said terminal housing member to define a continuous channel open in said attachment direction, and said second housing being insertable into said channel on engagement of said first and second housings, wherein said first housing defines a retainer insertion hole extending substantially at right angles to said attachment direction from the exterior of said first housing via said channel into said tubular housing member, and adapted to receive a retainer, said retainer being insertable through said retainer insertion hole from a waiting position to a final position in which in use the retainer protrudes into said tubular housing member to retain a terminal fitting against removal, wherein one of, said retainer and second housing is provided with an inclined face for contact with the other of said retainer and second housing whereby insertion of said second housing into said channel moves said retainer from the waiting position to the final position.

2. A connector according to claim 1 wherein in the waiting position the outer end of said retainer is substantially flush with the mouth of said retainer insertion hole and with the outer surface of said hood.

3. A connector according to claim 1 wherein in the final position said retainer is wholly inboard of said channel.

4. A connector according to claim 2 wherein in the final position said retainer is wholly inboard of said channel.

5. A connector according to claim 1 wherein said inclined face faces in the attachment direction.

6. A connector according to claim 5 wherein said inclined face is provided on said retainer.

7. A connector according to claim 6 wherein said inclined face extends to the outer end of said retainer.

8. A connector according to claim 1 wherein said channel is blind, a resilient annular seal being provided at the base of said channel for engagement with said second housing.

9. A connector according to claim 8 wherein said seal engages an inner wall of said channel, and is spaced from the outer wall thereof, said second housing entering the space between said seal and outer wall in use.

10. A connector according to claim 8 wherein said seal extends from the base of said channel to said retainer insertion hole.

11. A connector according to claim 9 wherein said seal extends from the base of said channel to said retainer insertion hole.

12. A connector according to claim 10 wherein said seal engages a side of the retainer in both the waiting and final positions.

13. A connector according to claim 11 wherein said seal engages a side of the retainer in both the waiting and final positions.

14. A connector according to claim 1 wherein said second housing includes a hood insertable into said channel, the edge of said hood engaging said retainer.

* * * * *